US009474925B1

(12) United States Patent
Hsiung

(10) Patent No.: US 9,474,925 B1
(45) Date of Patent: Oct. 25, 2016

(54) THREE-IN-ONE EXERCISE BICYCLE COMBINING AN UPRIGHT BICYCLE AND ELLIPTICAL TRAINER WITH A RECUMBENT BICYCLE

(71) Applicant: Bob Hsiung, Walnut, CA (US)

(72) Inventor: Bob Hsiung, Walnut, CA (US)

(73) Assignee: Hupa International Inc., Walnut, CA (US)

( * ) Notice: Subject to any disclaimer, the term of this patent is extended or adjusted under 35 U.S.C. 154(b) by 175 days.

(21) Appl. No.: 13/867,903

(22) Filed: Apr. 22, 2013

(51) Int. Cl.

| | |
|---|---|
| ***A63B 22/12*** | (2006.01) |
| ***A63B 69/16*** | (2006.01) |
| ***A47D 13/04*** | (2006.01) |
| ***A61H 3/00*** | (2006.01) |
| ***A63B 21/22*** | (2006.01) |
| ***A63B 22/06*** | (2006.01) |

(52) U.S. Cl.
CPC ..... *A63B 21/225* (2013.01); *A63B 22/0664* (2013.01); *A63B 2022/0635* (2013.01); *A63B 2022/0641* (2013.01); *A63B 2022/0652* (2013.01)

(58) Field of Classification Search
CPC ..... A63B 22/0664; A63B 22/08; A63B 2022/0652; A63B 2022/067; A63B 21/225; A63B 21/4034; A63B 22/0605; A63B 2022/0676; A63B 22/06; A63B 2022/0635; A63B 2022/0641; A63B 2022/0647; A63B 2022/0682; A63B 2022/0688; A63B 21/4033; A63B 23/4076; A63B 69/16
USPC ..... 482/51, 52, 53, 57, 62, 66, 140
See application file for complete search history.

(56) References Cited

U.S. PATENT DOCUMENTS

| | | | | |
|---|---|---|---|---|
| 5,916,065 | A * | 6/1999 | McBride et al. | 482/57 |
| 5,928,114 | A * | 7/1999 | Chen | 482/57 |
| 6,159,132 | A | 12/2000 | Chang | |
| D438,264 | S | 2/2001 | Hsiung | |
| D459,773 | S | 7/2002 | Hsiung | |
| 7,338,414 | B1 | 3/2008 | Hsiung | |
| 7,462,136 | B2 * | 12/2008 | Pan et al. | 482/52 |
| 7,473,210 | B1 | 1/2009 | Hsiung | |
| 7,951,048 | B1 | 5/2011 | Hsiung | |
| 8,257,230 | B2 * | 9/2012 | Chen et al. | 482/52 |
| 2006/0100064 | A1 * | 5/2006 | Pan et al. | 482/52 |
| 2008/0254948 | A1 * | 10/2008 | Chen | 482/52 |
| 2009/0239714 | A1 * | 9/2009 | Sellers | 482/52 |
| 2010/0267519 | A1 * | 10/2010 | Johnson, II | 482/8 |
| 2011/0028277 | A1 * | 2/2011 | Merli | 482/63 |
| 2012/0277066 | A1 * | 11/2012 | Hsu | 482/57 |
| 2014/0080676 | A1 * | 3/2014 | Wang | 482/52 |
| 2014/0274574 | A1 * | 9/2014 | Shorten | A63B 22/0046 482/52 |

* cited by examiner

*Primary Examiner* — Loan H Thanh
*Assistant Examiner* — Nyca T Nguyen
(74) *Attorney, Agent, or Firm* — Thomas I. Rozsa

(57) ABSTRACT

A single exercise bicycle which combines a standard upright bicycle with an elliptical trainer combined with a recumbent bicycle. The three-in-one bicycle includes added pedals which allow full support of a user's feet when the rider's body is in a reclining position. The exercise bicycle enables a rider to stand while performing an elliptical training exercise.

4 Claims, 5 Drawing Sheets

THREE-IN-ONE EXERCISE BICYCLE COMBINING AN UPRIGHT BICYCLE AND ELLIPTICAL TRAINER WITH A RECUMBENT BICYCLE

BACKGROUND OF THE INVENTION

1. Field of the Invention

The present invention relates to the field of exercise equipment and in particular, to different types of exercise equipment such a standard bicycle, an elliptical trainer, and a recumbent bicycle, all of which are used for physical fitness.

2. Description of the Prior Art

The present inventor is a major innovator in the present field of invention. The present inventor has the following patents for which improvement in this field would be very beneficial:

1. U.S. Pat. No. 7,338,414 issued to Bob Hsiung on Mar. 4, 2008 for "APPARATUS TO ENABLE A USER TO SIMULATE SKATING";

2. U.S. Pat. No. 7,473,210 issued to Bob Hsiung on Jun. 6, 2009 for "APPARATUS TO ENABLE A USER TO SIMULATE SKATING".

3. U.S. Pat. No. 7,951,048 issued to Bob Hsiung on May 31, 2001 for "ABDOMINAL SWIVELING EXERCISE MACHINE COMBINED WITH AN ELLIPTICAL. TRAINER EXERCISE MACHINE OR SKATE SIMULATION TRAINER OR EXERCISE BICYCLE OR RECUMBENT BICYCLE".

4. U.S. Design Pat. D459,773 issued to Bob Hsiung on Jul. 2, 2002 for "STEPPER WITH ARM MOTION".

5. U.S. Design Pat. D438,264 issued to Bob Hsiung on Feb. 27, 2001 for "ELLIPTICAL STRIDING EQUIPMENT".

The inventor Bob Hsiung is also the owner by assignment of U.S. Pat. No. 6,159,132 by inventor Jack Chang issued on Dec. 12, 2000 for "OVAL-TRACKED EXERCISE DEVICE".

There is a significant need for an improvement in exercise bicycles which can combine three bicycles in one piece of exercise equipment.

SUMMARY OF THE INVENTION

The present invention a single piece of exercise bicycle equipment which combines a standard upright bicycle with an elliptical trainer combined with a recumbent bicycle.

It is an object of the present invention to incorporate features from U.S. Pat. No. 6,159,132 which disclose a standard upright bicycle and an oval tracked elliptical bike and include a support and horizontal arms to add the feature of a recumbent bicycle to the exercise device.

It is a further object of the present invention to provide a three-in-one bicycle where the added pedals will allow full support of a user's feet when the rider's body is in a reclining position. The design also enables a rider to apply more force.

It is also an object of the present invention to include a recumbent pedal feature which will not alter or interfere with the upright and elliptical bike functions It is an additional object of the present invention to provide a three-in-one bicycle where using the equipment as an elliptical bicycle involves movement while using it as an upright bicycle involves mid and lower body movement. As a recumbent bicycle, the equipment allows for lower body workout and burns more calories.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
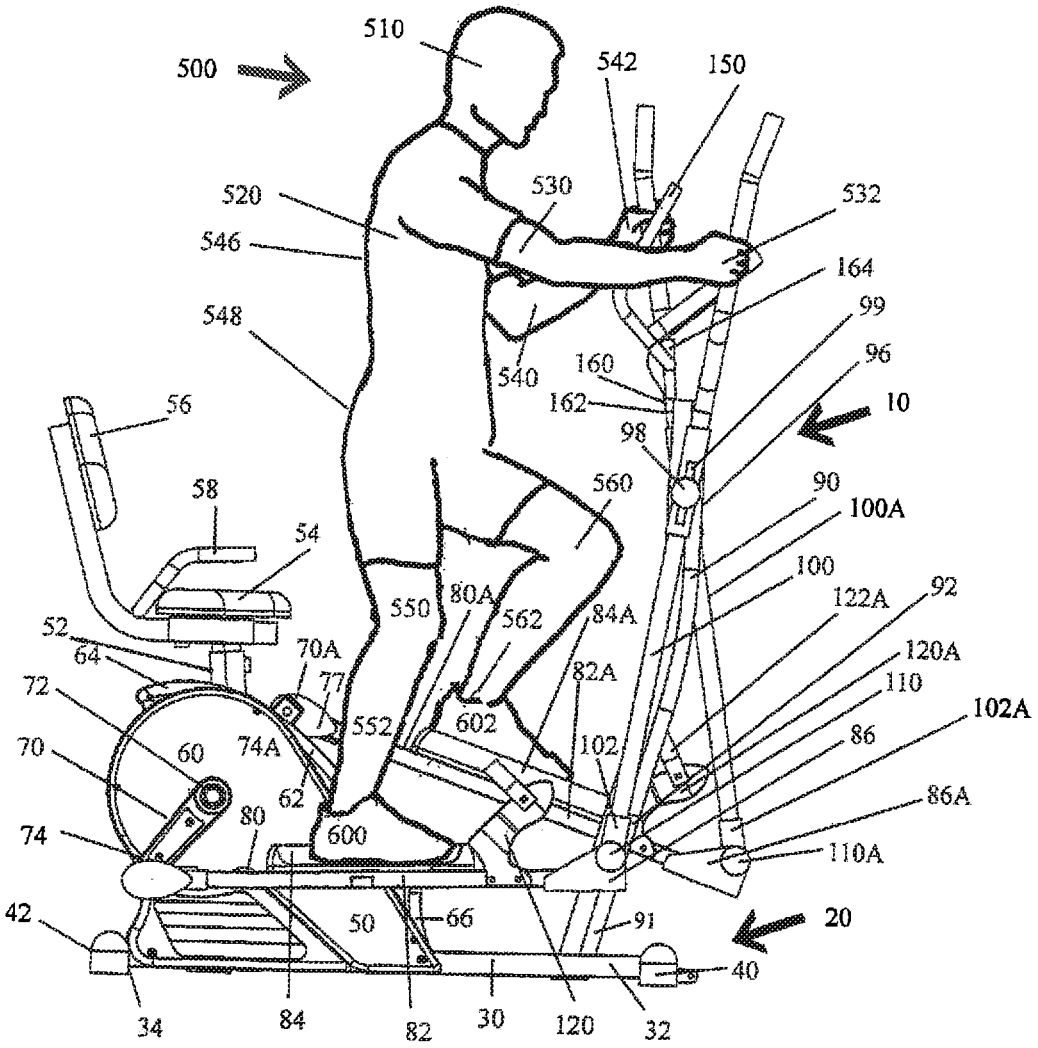
FIG. 1 is a side perspective view of the present invention three-in-one exercise bicycle being used as an elliptical trainer.
Figure 2:
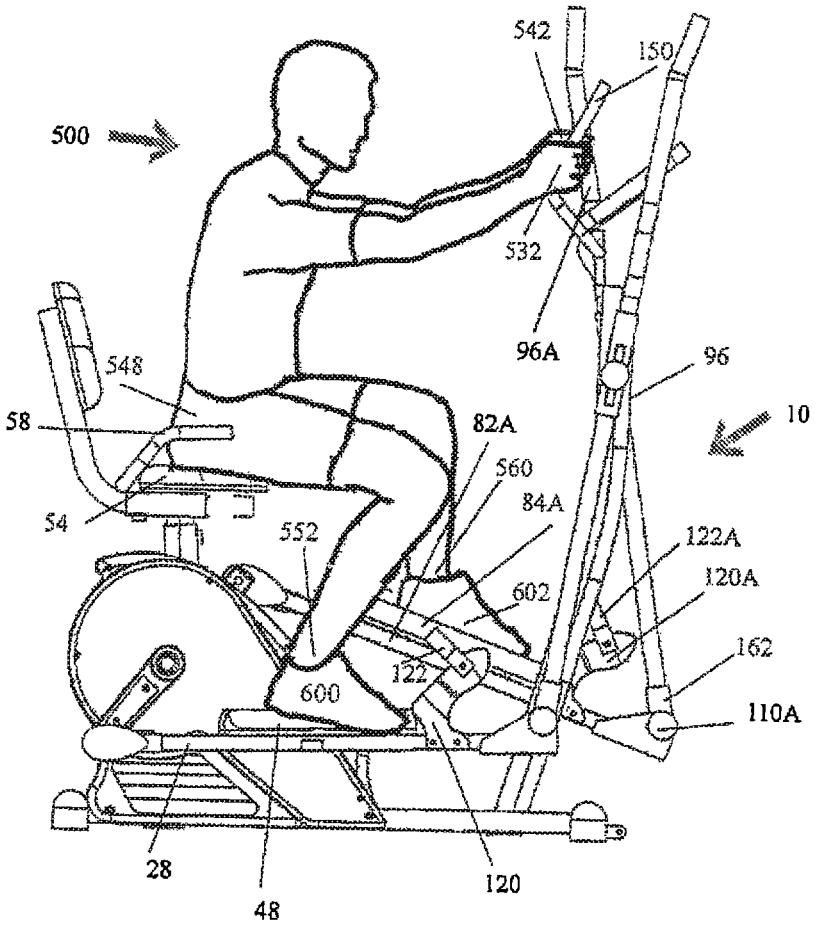
FIG. 2 is a is side perspective view of the present invention three-in-one bicycle being used as a standard upright bicycle.
Figure 3:
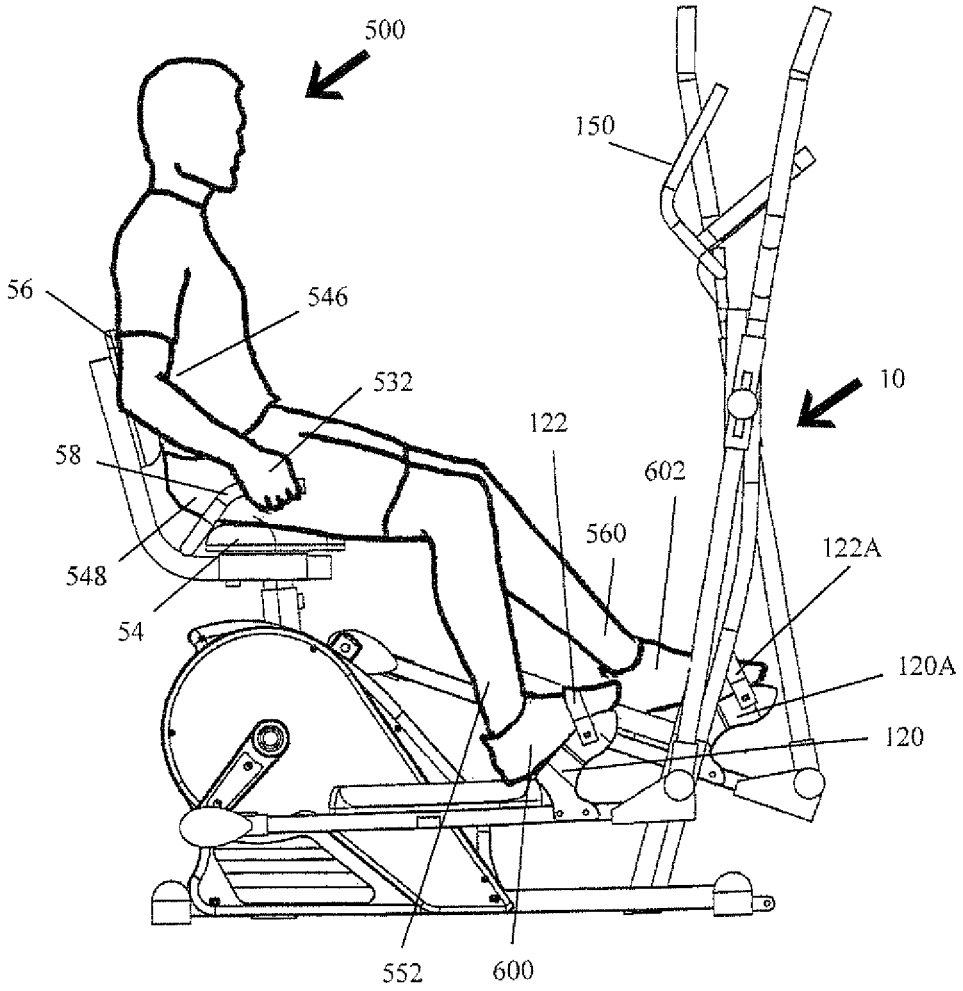
FIG. 3 is a side perspective view of the present invention three-in-one bicycle being used as a recumbent bicycle.

Referring to FIGS. 1 through 3, there is illustrated the present invention three-in-one exercise bicycle 10. The bicycle 10 includes a base 20 comprised of at least one longitudinal bar 30 with a first end 32 to which a first transverse bar 40 is connected. The at least one longitudinal bar 30 having a rear end 34 to which a second transverse bar 42 is connected, thereby providing stability to the exercise bicycle 10. A bicycle body 50 supports a resistance flywheel 60. The bicycle body 50 supports a post 52 which in turn supports a seat 54 with a backrest 56, a first seat handlebar 58 and a parallel oppositely disposed second seat handlebar (not shown) The resistance flywheel 60 is covered by a top end 64 of a cover 62. The cover 62 is attached at its bottom end 66 to longitudinal bar 30.

Connected to the flywheel 60 is a first crank axle 70 with a first end 72 rotatably connected to the resistance flywheel 60 and a second end 74 rotatably connected to a first or right elliptical trainer pedal assembly 80 having a first or right longitudinal pedal bar 82 to which a first or right foot pedal 84 is connected. The first longitudinal pedal bar 82 is rotatably connected to the first or right vertical handle 100 at the longitudinal pedal bar's front end 86 through a first transverse rod 110 connected to the first vertical handle 100. The first transverse rod 110 connected to front 86 of the first or right longitudinal pedal bar 82 is also connected to the first vertical handle 100 and its lower end 102. The first transverse rod 110 also is connected to the lower end 102 of right vertical handle 100. The stationary vertical post 90 with a lower section 92 is fixed at its lower end 91 to at least one longitudinal bar 30. In addition, the right vertical handle 100 is rotatably connected at its lower end 102 by the first transverse rotatable rod 110 to the front 86 of first or right longitudinal pedal bar 82. The right vertical handle 100 is rotatably connected at a higher location of the right vertical handle 100 to a higher location 96 of stationary vertical post 90 by a second transverse rod 98 in a slot member 99 of the right vertical handle 100 to enable the right vertical handle 100 to move back and forth. In addition, the present invention includes a right recumbent foot pedal member 120 attached to the right or longitudinal pedal bar 82 at a location adjacent to the rotatable lower connection of the right vertical handle 100 and the first or right longitudinal pedal bar 82. The right recumbent foot pedal 120 also includes a right foot strap 122 (see FIG. 3) into which a rider's right foot is inserted so that the exercise bike 10 can also be used as a recumbent bicycle. The stationary vertical post 90 includes an intermediate section 160 having a lower portion 162 and a top section 164 with a riding handle attached to the top section 164 of the stationary vertical post 90. The vertical post 90 is stationary and is connected at its lower end 91 to longitudinal bar 30.

Also connected to the flywheel 60 is a second crank axle 70A with a first end (not shown) rotatably connected to the resistance flywheel 60 and a second end 74A rotatably connected to a second or left elliptical trainer pedal assembly 80A having a second or left longitudinal pedal bar 82A to which a second or left foot pedal 84A is connected. The second longitudinal pedal bar 82A is rotatably connected to the second or left vertical handle 100A at the longitudinal pedal bar's front end 86A through a third transverse rod 110A connected to the second vertical handle 100A. The third transverse rod 110A is connected to front 86A of the second or left longitudinal bar 82A and is also connected to the second vertical handle 100A and its lower end 102A. The left vertical handle 100A is rotatably connected at its lower end 102A to the front 86A of the left longitudinal pedal bar 82A by the third transverse rotatable rod 110A. The left vertical handle 100A is also rotatably connected at a higher location 96A (see FIG. 2) by a fourth transverse rod (not shown) in a slot (not shown) to the stationary vertical post 90 to enable the left vertical handle 100A to move back and forth. In addition, the present invention includes a left recumbent foot pedal member 120A attached to the second or left longitudinal pedal bar 82A at a location adjacent to the rotatable lower connection of the left vertical handle 100A and the second or left longitudinal pedal bar 82A. The left recumbent second foot pedal 120A also includes a left foot strap 122A (see FIG. 2) into which a left rider's foot is inserted so that the exercise bike 10 can also be used as a recumbent bicycle.

In one variation, the right foot strap and the left foot strap are eliminated so that the right foot rests onto and holds onto the right recumbent foot pedal and the left foot rests on and retained onto the left recumbent foot pedal. With the straps, the right and left straps respectively retain the right and left foot respectively onto the right and left recumbent foot pedals.

In an additional alternative variation, the first or right foot pedal 84 and the second or left foot pedal 84A have been illustrated as being formed in one piece. It will be appreciated that for purposes of assembly and disassembly and storage, it is also within the spirit and scope of the present invention for each foot pedal 84 and 84A on a respective longitudinal pedal bar 82 and 82A to be formed in two or more pieces so that they can be assembled together into one final piece.

In another alternative embodiment, the right recumbent foot pedal 120 and the left recumbent second foot pedal 120A have been described as being formed in one piece. It will be appreciated that the right recumbent foot pedal 120 and the left recumbent foot pedal 120A can be formed in two or more pieces for easy assembly and disassembly.

Figure 4:
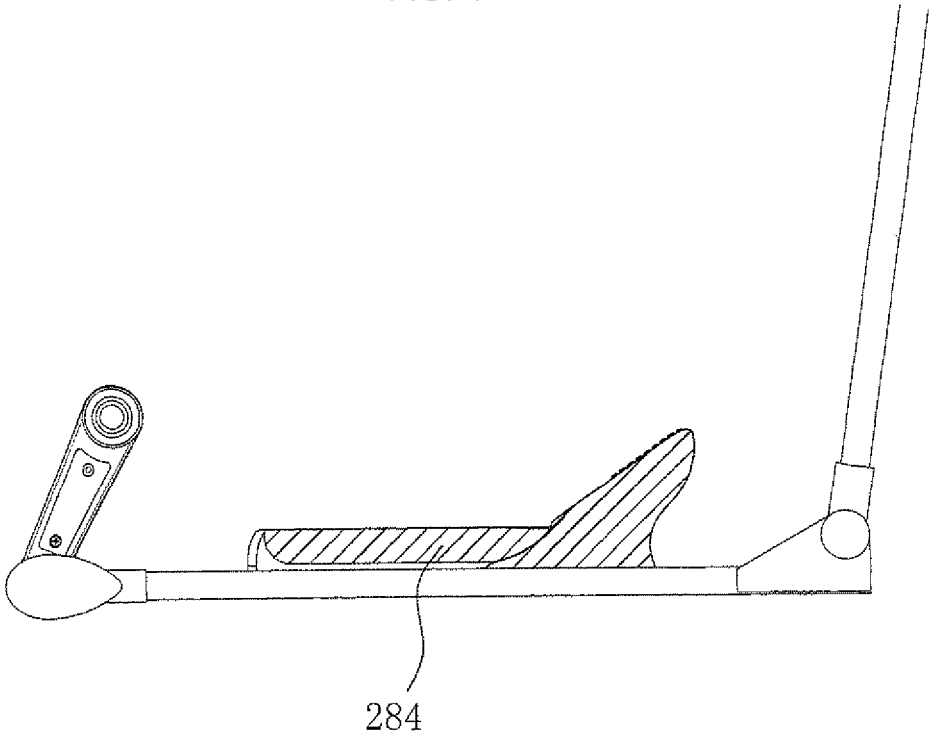
FIG. 4 is a side elevational view of a one-piece combination right foot pedal and right recumbent foot pedal.

Further, the right and left foot pedals 84 and 84A have each been illustrated as a one piece foot pedals. The right and left recumbent foot pedals 120 and 120A have each been illustrated as a one piece recumbent foot pedal It is also within the spirit and scope of the present invention for the right foot pedal and right recumbent foot pedal to be united or combined into one piece. Similarly, the left foot pedal and left recumbent foot pedal can be combined into one piece. Illustrated in FIG. 4 is the one piece combination right foot pedal and left foot pedal numbered 284.

Figure 5:
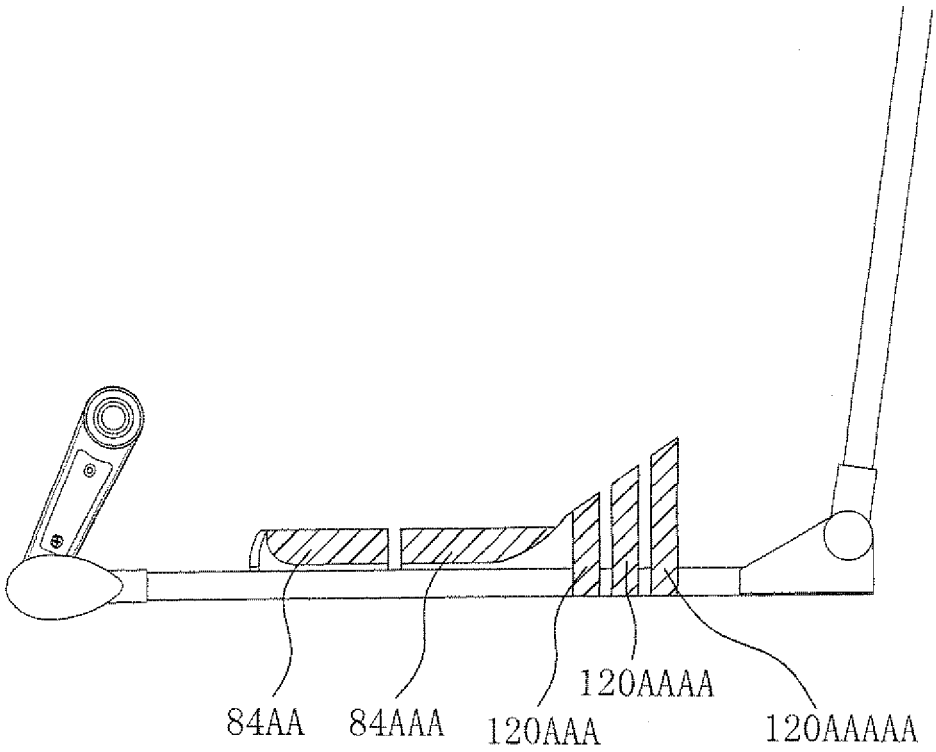
FIG. 5 is a side elevational view of a right foot pedal in two pieces and a separate right recumbent foot peal in three pieces.

Also, the left and right foot pedals can each be in be in two or more pieces as illustrated in FIG. 5 where the right foot pedal is in two pieces 84AA and 84AAA. The left and right recumbent foot pedals can each be in two or more pieces as illustrated in FIG. 5 where the right recumbent foot pedal is in three pieces 120AAA, 120AAAA and 120AAAAA.

The first and second longitudinal pedal bars 82 and 82A have each been illustrated as being straight and being in one piece. It is also within the spirit and scope of the present invention for the longitudinal pedals bars to each be curved and each be formed into more than one interlockable sections so that each can be formed in at least two interlockable sections which can be straight or curved.

The three-in-one use of the present invention exercise bicycle 10 is demonstrated in the three figures. The rider 500 has a head 510, a torso 520, a right arm 530 terminating in a right hand 532, a left arm 540 terming in a left hand 542, a back 546, a rear end 548, a right thigh and right leg 550 terminating in a right foot 552 wearing a right shoe 600, a left thigh and left leg 560 terminating in a left foot 562 wearing a left shoe 602.

In FIG. 1, the rider is using the exercise bicycle 10 as an elliptical trainer. The rider 500 is in a standing position. The right hand 532 is holding the right vertical handle 100, the right foot 552 wearing a right shoe 600 is placed on the right foot pedal 84, the left hand 542 is holding the left vertical handle 100A and the left foot 562 wearing a left shoe 602 is placed on the left foot pedal 84A. The rider moves the vertical handles 100 and 100A with the rider's hands 532 and 542 causing the foot pedals 84 and 84A connected to their respective longitudinal pedal bars 82 and 82A to rotate in an oval or elliptical motion, and the right and left vertical handles also move back and forth, providing exercise to the rider's entire body.

In FIG. 2, the 500 rider is seated and is using the exercise bicycle 10 as an standard bicycle. The right hand 532 and left hand are each holding the vertical riding handle 150, the right foot 552 wearing a right shoe 600 is placed on the right foot pedal 84, the left foot 560 wearing a left shoe 602 is placed on the left foot pedal 84A. The rider's rear end 548 is seated on bicycle seat 54. The rider holds the vertical riding handle 150 with the rider's hands 532 and 542 and pedals down on the right foot pedal 84 and left foot pedal 84A causing the foot pedals 84 and 84A connected to their respective longitudinal pedal bars 82 and 82A to move up and down simulating a standard bicycle, providing exercise to the rider's mid-body and lower legs.

In FIG. 3, the rider is using the exercise bicycle 10 as a recumbent bicycle. The right hand 532 is holding the first seat handlebar 58, the right foot 552 wearing a right shoe 600 is placed into the right strap 122 on the right recumbent foot pedal 120 (the right strap 122 is optional and the rider can place and hold the rider's right foot directly onto the right recumbent foot pedal with no right strap 122), the left hand 542 is holding the second seat handlebar (not shown) and the left foot 560 wearing a left shoe 562 is placed into the left strap 122A on the left recumbent foot pedal 120A (the left strap 122A is optional and the rider can place and hold the rider's left foot directly onto the left recumbent foot pedal with no left strap 122A). The rider's rear end 548 is seated on the bicycle seat 54 and the rider's back 546 rests against backrest 56 so that the rider is seated at an angle or recumbent position. The rider respectively holds onto the first and second seat handlebars and moves the recumbent foot pedals 120 and 120A with the rider's feet 552 and 552A wearing shoes 600 and 600A causing the longitudinal pedal bars 82 and 82A to move back and forth providing significant exercise to the rider's legs.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. An exercise bicycle comprising:

a. a base including at least one longitudinal bar with a first end to which a first transverse bar is connected, the at least one longitudinal bar having a rear end to which a second transverse bar is connected, a bicycle body supporting a resistance flywheel, the bicycle body supporting a post which in turn supports a seat with a backrest, a first seat handlebar and a parallel oppositely disposed second seat handlebar;

b. a first crank axle including a first end rotatably connected to the resistance flywheel and a second end rotatably connected to a right elliptical trainer pedal assembly having a right longitudinal pedal bar to which a right foot pedal is affixed and entirely oriented parallel to and aligned with the right longitudinal pedal bar, the right foot pedal having an upper surface formed along a length of the right foot pedal having a planar non-bent shape, a first end of the right longitudinal pedal bar is rotatably connected to a lower end of a right vertical handle by a first transverse rod and said right vertical handle is rotatably connected at an elevated distance from its lower end to a stationary vertical post by a second transverse rod to enable the right vertical handle to move back and forth at the location of said first transverse rod with the second transverse rod acting as a pivot, a right recumbent foot pedal attached to the right longitudinal pedal bar at a location adjacent the rotatable connection of the right vertical handle and the right longitudinal pedal bar, the right foot pedal and the right recumbent foot pedal are formed as two separate foot pedals, the right recumbent foot pedal including an inclined surface, wherein an entire length of the inclined surface of the right recumbent foot pedal is formed at a fixed upwardly extending angle relative to an entire length of the right longitudinal pedal bar, a second end of the right longitudinal pedal bar is rotatably connected to the second end of the first crank axle;

c. a second crank axle including a first end rotatably connected to the resistance flywheel and a second end rotatably connected to a left elliptical trainer pedal assembly having a left longitudinal pedal bar to which a left foot pedal is affixed and entirely oriented parallel to and aligned with the left longitudinal pedal bar, the left foot pedal having an upper surface formed along a length of the left foot pedal having a planar non-bent shape, a first end of the left longitudinal pedal bar is rotatably connected to a lower end of a left vertical handle by a third transverse rod and said left vertical handle is rotatably connected at an elevated distance from its lower end to said stationary vertical post by a fourth transverse rod to enable the left vertical handle to move back and forth at the location of said third transverse rod with the fourth transverse rod acting as a pivot, a left recumbent foot pedal attached to the left longitudinal pedal bar at a location adjacent the rotatable lower connection of the left vertical handle and the left longitudinal pedal bar, the left foot pedal and the left recumbent foot pedal are formed as two separate foot pedals, the left recumbent foot pedal including an inclined surface, wherein an entire length of the inclined surface of the left recumbent foot pedal is formed at a fixed upwardly extending angle relative to an entire length of the left longitudinal pedal bar, a second end of the left longitudinal pedal bar is rotatably connected to the second end of the second crank axle; and d. said stationary vertical post is affixed at its lower end to at least said at least one longitudinal bar, said stationary vertical post is located between said right vertical handle and said left vertical handle, a riding handle affixed to said stationary vertical post at a location adjacent a top end of said stationary vertical post;

e. whereby said exercise bicycle functions as a three-in-one exercise elliptical trainer, upright bicycle and recumbent bicycle;

f. whereby when used as an elliptical trainer, the exercise bicycle is configured such that a user stands placing the user's right foot on the right foot pedal and grasps the right vertical handle with the user's right hand, and the user places the user's left foot on the left foot pedal and grasps the left vertical handle with the user's left hand;

g. whereby when used as an upright bicycle, the exercise bicycle is configured such that the user is seated on said seat, the user places the user's right foot on the right foot pedal and grasps the riding handle with the user's right hand and places the user's left foot on the left foot pedal and grasps the riding handle with the user's left hand;

h. whereby when used as a recumbent bicycle, the exercise bicycle is configured such that the user is seated and rests the user's back against said backrest, the user places the user's right foot against said inclined surface of said right recumbent foot pedal and grasps said first seat handlebar with the user's right hand, and places the user's left foot against the inclined surface of the left recumbent foot pedal and grasps said second seat handlebar with the user's left hand.

2. The exercise apparatus in accordance with claim 1, further comprising:

a. said right vertical handle includes a slot through which the second transverse rod extends; and b. said left vertical handle includes a slot through which the fourth transverse rod extends.

3. An exercise bicycle comprising:

a. a base including at least one longitudinal bar with a first end to which a first transverse bar is connected, the at least one longitudinal bar having a rear end to which a second transverse bar is connected, a bicycle body supporting a resistance flywheel, the bicycle body supporting a post which in turn supports a seat with a backrest, a first seat handlebar and a parallel oppositely disposed second seat handlebar;

b. a first crank axle including a first end rotatably connected to the resistance flywheel and a second end rotatably connected to a right elliptical trainer pedal assembly having a right longitudinal pedal bar to which a right foot pedal is affixed and entirely oriented parallel to and aligned with the right longitudinal pedal bar, the right foot pedal having an upper surface formed along a length of the right foot pedal having a planar non-bent shape, a first end of the right longitudinal pedal bar is rotatably connected to a lower end of a right vertical handle by a first transverse rod and said right vertical handle is rotatably connected at an elevated distance from its lower end to a stationary vertical post by a second transverse rod to enable the right vertical handle to move back and forth at the location of said first transverse rod with the second transverse rod acting as a pivot, a right recumbent foot pedal attached to the right longitudinal pedal bar at a location adjacent the rotatable connection of the right vertical handle and the right longitudinal pedal bar, the right foot pedal and the right recumbent foot pedal are formed as two separate foot pedals, the right recumbent foot pedal including an inclined surface, wherein an entire length of the inclined surface of the right recumbent foot pedal is formed at a fixed upwardly extending angle relative to an entire length of the right longitudinal pedal bar, a second end of the right longitudinal pedal bar is rotatably connected to the second end of the first crank axle;

c. a second crank axle including a first end rotatably connected to the resistance flywheel and a second end rotatably connected to a left elliptical trainer pedal assembly having a left longitudinal pedal bar to which a left foot pedal is affixed and entirely oriented parallel to and aligned with the left longitudinal pedal bar, the left foot pedal having an upper surface formed along a length of the left foot pedal having a planar non-bent shape, a first end of the left longitudinal pedal bar is rotatably connected to a lower end of a left vertical handle by a third transverse rod and said left vertical handle is rotatably connected at an elevated distance from its lower end to said stationary vertical post to enable the left vertical handle to move back and forth at the location of said third transverse rod with the said second transverse rod acting as a pivot, a left recumbent foot pedal attached to the left longitudinal pedal bar at a location adjacent the rotatable lower connection of the left vertical handle and the left longitudinal pedal bar, the left foot pedal and the left recumbent foot pedal are formed as two separate foot pedals the left recumbent foot pedal including an inclined surface, wherein an entire length of the inclined surface of the left recumbent foot pedal is formed at a fixed upwardly extending angle relative to an entire length of the left longitudinal pedal bar, a second end of the left longitudinal pedal bar is rotatably connected to the second end of the second crank axle; and d. said stationary vertical post is affixed at its lower end to at least said at least one longitudinal bar, said stationary vertical post is located between said right vertical handle and said left vertical handle, a riding handle affixed to said stationary vertical post at a location adjacent a top end of said stationary vertical post;

e. whereby said exercise bicycle functions as a three-in-one exercise elliptical trainer, upright bicycle and recumbent bicycle;

f. whereby when used as an elliptical trainer, the exercise bicycle is configured such that a user stands placing the user's right foot on the right foot pedal and grasps the right vertical handle with the user's right hand, and the user places the user's left foot on the left foot pedal and grasps the left vertical handle with the user's left hand;

g. whereby when used as an upright bicycle, the exercise bicycle is configured such that the user is seated on said seat, the user places the user's right foot on the right foot pedal and grasps the riding handle with the user's right hand and places the user's left foot on the left foot pedal and grasps the riding handle with the user's left hand;

h. whereby when used as a recumbent bicycle, the exercise bicycle is configured such that the user is seated and rests the user's back against said backrest, the user places the user's right foot against said inclined surface of said right recumbent foot pedal and grasps said first seat handlebar with the user's right hand, and places the user's left foot against the inclined surface of the left recumbent foot pedal and grasps said second seat handlebar with the user's left hand.

4. The exercise apparatus in accordance with claim 3, further comprising:

a. said right vertical handle includes a slot through which the second transverse rod extends; and b. said left vertical handle includes a slot.

* * * * *